United States Patent [19]

Hahne et al.

[11] Patent Number: 4,835,808

[45] Date of Patent: Jun. 6, 1989

[54] PROBE FOR REMOVING DUST FROM MOVING WEBS

[75] Inventors: Ernst-August Hahne, Allschwil, Switzerland; Hermann Künzig, Weil am Rhein, Fed. Rep. of Germany

[73] Assignee: Eltex-Elektrostatik Gesellschaft mbH, Weil am Rhein, Fed. Rep. of Germany

[21] Appl. No.: 43,186

[22] Filed: Apr. 27, 1987

[30] Foreign Application Priority Data

Apr. 29, 1986 [EP] European Pat. Off. ..... 86105867.5

[51] Int. Cl.[4] ..... B08B 5/04

[52] U.S. Cl. ..... 15/1.5 R; 15/306 A

[58] Field of Search ..... 15/1.5 R, 306 R, 306 A, 15/345

[56] References Cited

U.S. PATENT DOCUMENTS

| | | | |
|---|---|---|---|
| 2,818,595 | 1/1958 | Rosewall | 15/306 A |
| 2,920,987 | 1/1960 | Landry et al. | 15/1.5 R |
| 3,074,086 | 1/1963 | Remer | 15/1.5 R |
| 3,239,863 | 3/1966 | Gardner | 15/1.5 R |
| 3,395,042 | 7/1968 | Herbert, Jr. | 15/1.5 R |
| 4,198,061 | 4/1980 | Dunn | 15/306 R |
| 4,281,431 | 8/1981 | Nierlich et al. | 15/306 A |
| 4,454,621 | 6/1984 | Testone | 15/1.5 R |
| 4,677,704 | 7/1987 | Huggins | 15/306 R |

*Primary Examiner*—Harvey C. Hornsby
*Assistant Examiner*—Corinne M. Reinckens
*Attorney, Agent, or Firm*—Max Fogiel

[57] ABSTRACT

A probe is employed for removing dust from moving webs, paper webs for example. It has at least one electrostatic high-voltage electrode, at least one blower for gas, preferably air, oriented against the direction that the web travels in, and a vacuum channel for suctioning up the dust-laden gas. The pointed or blade-shaped subsidiary electrodes in the high-voltage electrode (10) lie in a plane that does not parallel the web (7). The direction that the row of round and/or slotted nozzles (12) in the blower (11) blow along lies in another plane downstream of the high-voltage electrode (10). The two planes intersect at a line that lies in the plane of the web (7) and extends across it. The round and/or slotted openings (14) into the vacuum channel (13) are on the other hand positioned upstream of the high-voltage electrode (10) in the web-travel direction (8).

30 Claims, 3 Drawing Sheets

PROBE FOR REMOVING DUST FROM MOVING WEBS

BACKGROUND OF THE INVENTION

The invention concerns a dust-removal probe as recited in the preamble to the major claim.

The problem of removing the dust from webs of paper with probes has not as yet been satisfactorily solved.

SUMMARY OF THE INVENTION

The object of the invention is accordingly to improve the generic dust-removal probe to the extent that dust can be removed more effectively.

This object is attained in accordance with the invention in a generic probe as recited in the preamble to the major claim by the characteristics recited in the body thereof.

A rapidly moving web, of paper for example, entrains air as it moves more rapidly. The air travels parallel with the web. The result is a laminar flow at approximately the same speed as the web and in the immediate vicinity of hundredths of a millimeter above it that decreases linearly with its distance from the web. The blast of air emerging from the blower acts against the moving web and entrains the almost laminar flow of air traveling parallel with the web. The dust that moves within the flow whirls up along with the dust that does not adhere very tightly and is forced toward the vacuum channel. The vacuum in the vacuum channel is powerful enough to suction up the whirling dust. The high-voltage electrode inside the probe discharges both the web and the particles of dust, allowing the blower to detach them and the vacuum channel to suction them in more easily.

The high-voltage electrode and the blower are oriented such that their planes intersect at a line that lies precisely on the web, and the discharging is accordingly optimal along that line. The air also acts like a doctor along the line, detaching the particles of dust. Orienting the vacuum channel down near the web, against the direction that the web travels in, and parallel with the blast emitted by the blower also helps to ensure that the whirling particles of dust can be suctioned up without any problems. The orientation of the flow into the openings into the vacuum channel, which lie within a fourth plane at an acute angle to the web, also contributes to attaining the objective.

Furthermore, a metal field plate is preferably mounted on the other side of the web from the probe and connected to a high-voltage generator with variable voltage and frequency. The resulting alternating field eliminates the forces between the particles of dust and the web. The rate of flow of the air employed for blasting and suction can also be adjusted in accordance with the speed of the web.

Further practical embodiments and developments of the invention are recited in the subsidiary claims.

BRIEF DESCRIPTION OF THE DRAWING

A sectional view of the probe in accordance with the present invention.

DESCRIPTION OF THE PREFERRED EMBODIMENTS

Figure 1:
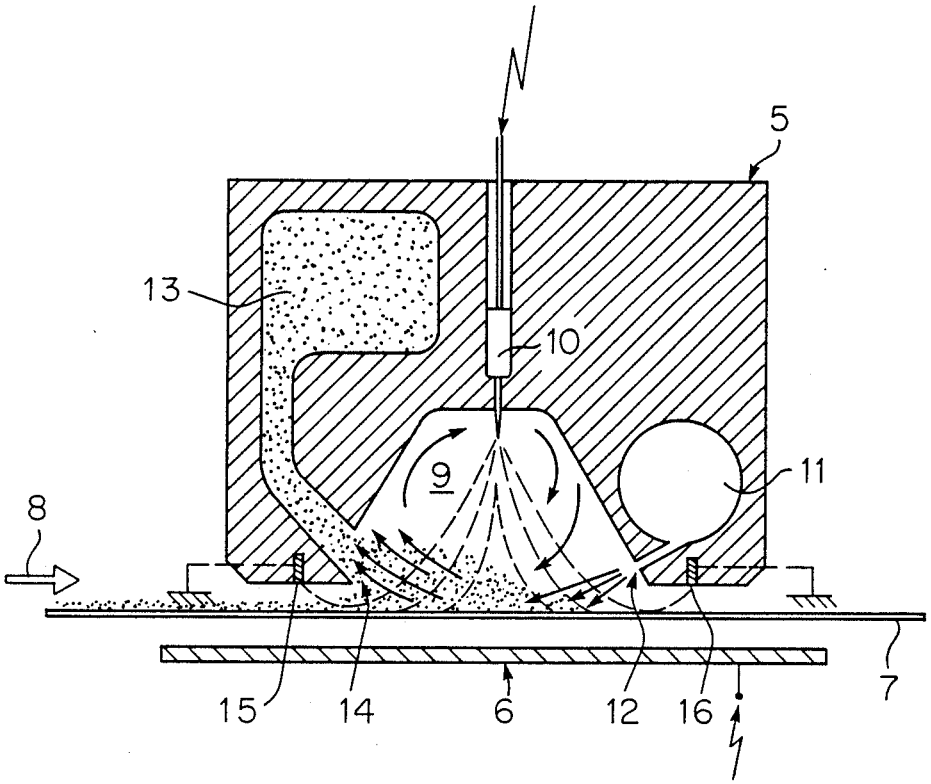
Figure 2:
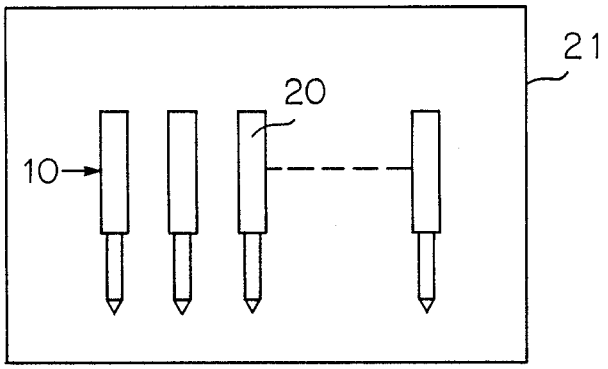
Figure 3:
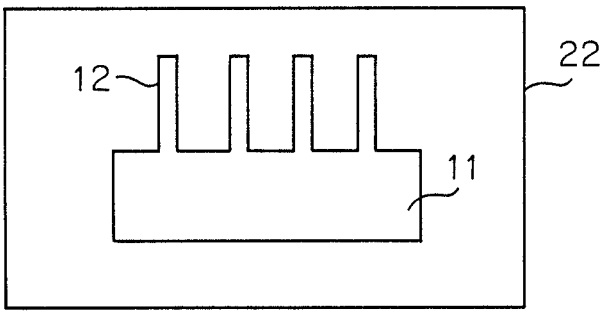
Figure 4:
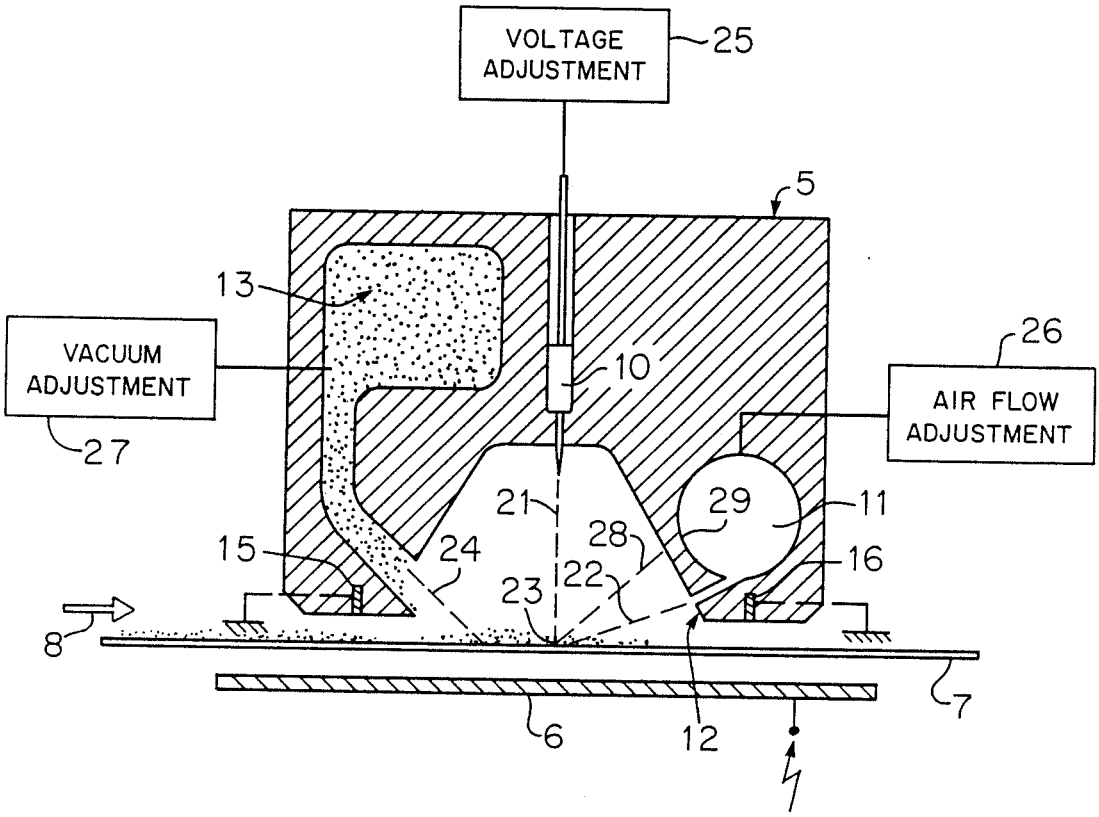

Between a probe 5 and a metal field plate 6 is a web 7, preferably of paper, that moves rapidly in the direction indicated by arrow 8.

Dust-removal probe 55 has a recess 9 that is trapezoidal as viewed in section parallel with web-travel direction 8. At its smaller base is a high-voltage electrode 10 in the form of a number of pointed subsidiary electrodes 20 arrayed in a line or of a single continuous blade-shaped electrode. Electrode 10 lies in a plane 21 perpendicular to web-travel direction 8. At the downstream end of probe 5 is a blower 11 with round or slotted nozzles 12 that lie in another plane 22. Both planes 21 and 22 intersect at a line 23 that lies in web 7, preferably at a right angle to web-travel direction 8.

At the upstream end of the probe is a vacuum channel 13 with round or slotted openings 14. The direction of flow into openings 14 lies in a fourth plane 24, which extends at an acute angle to web-travel direction 8.

The nozzles 12 in blower 11 and the openings 14 into vacuum channel 13 are positioned in the vicinity of the sides of trapezoidal recess 9 near its larger base.

Both upstream and downstream of trapezoidal recess 9, probe 5 has a ground electrode 15 and 16. Electrodes 15 and 16 are positioned on the bottom of probe 5 facing web 7 and extend over the total width of the probe. The electrodes 15,16 can consist of a number of pointed and/or blade-shaped subsidiary electrodes extending across and preferably at a right angle to web-travel direction 8 over the total width of the probe and hence of the web.

Field plate 6, which parallels web 7, is connected to a source of alternating current and can be activated at between 0 and 10 kV and between 0 and 10 kHz. High-voltage electrode 10 is also connected to a positive and negative source of direct or alternating voltage that can also be individually set.

The voltages and the rate of flow of the air emerging from blower 11, and the vacuum in channel 13 can all be varied by elements 25,26,27, respectively in accordance with the speed of web 7.

The blower can have an additional row of nozzles 29 lying in a plane 28 also intersecting the line 23.

We claim:

1. A probe for removing dust from moving paper webs, comprising at least on electrostatic high-voltage electrode; at least one air blower oriented against the direction of web movement; a vacuum channel for suctioning up dust-laden air; said high-voltage electrode comprising subsidiary electrodes lying in a first plane substantially perpendicular to said web; said blower having a row of nozzles blowing along a direction lying in a second plane inclined with respect to said first plane; said blower being located downstream of said high-voltage electrode in web-travel direction; said two planes intersecting at a line lying in a plane of the web and extending across said web; and openings onto said vacuum channel being positioned upstream of said high-voltage electrode web-travel direction; said air blower blowing air in a direction opposite to direction of web movement for breaking up an air stream of substantially laminar flow moving with said web to produce turbulence that picks up dust through the turbulence; said nozzles on said bolwer having a direction to apply an air stream onto said openings in said vacuum channel for producing maximum suction of air particles carried by the turbulence; said electrostatic high-voltage electrode being located in vicinity of the dust picked up by the turbulence.

2. A probe as defined in claim 1, wherein said subsidiary electrodes are positioned at an angle of 90°±30° with respect to said web.

3. A probe as defined in claim 1, wherein said subsidiary electrodes comprise pointed electrodes located parallel to one another in said first plane.

4. A probe as defined in claim 1, wherein said subsidiary electrodes operate with a positive and negative voltage.

5. A probe as defined in claim 4, wherein said voltage is within the range 2 and 10 kV.

6. A probe as defined in claim 1, wherein said blower has an additional row of nozzles lying in a third plane intersecting also said line of intersection.

7. A probe as defined in claim 6, wherein said second and third planes are oriented at an angle from 30° to 45° with respect to direction of web movement.

8. A probe as defined in claim 7, wherein said nozzles are round-shaped bores parallel to one another in said second or third plane.

9. A probe as defined in claim 1, wherein said line of intersection extends perpendicular to direction of web movement.

10. A probe as defined in claim 1, wherein said openings in said vacuum channel open in vicinity of said web.

11. A probe as defined in claim 10, wherein flow into said openings in said vacuum channel has a direction lying within a fourth plane oriented at an acute angle to direction of web movement.

12. A probe as defined in claim 11, wherein said acute angle extends up to substantially 70°.

13. A probe as defined in claim 1, wherein said probe has a trapezoidal-shaped recess chamber with a larger base and a smaller base, said high-voltage electrode having an end at said smaller base, the larger base facing said web, said blower being located on one side of said chamber and inflow opening into said vacumm channel being located on another side of said chamber.

14. A probe as defined in claim 13, wherein said inflow opening into said vacuum channel is positioned at bottom of said probe.

15. A probe as defined in claim 1, including a first ground electrode positioned upstream of said vacuum channel in direction of web movement; and a second ground electrode positioned downstream of said blower along direction.

16. A probe as defined in claim 15, wherein said first and second ground electrodes are positioned on a bottom facing said web and extending over the total width of said probe.

17. A probe as defined in claim 16, wherein said ground electrodes are pointed.

18. A probe as defined in claim 16, wherein said ground electrodes are blade-shaped.

19. A probe as defined in claim 16, wherein said ground electrodes are located outside said trapezoidal-shaped recess chamber.

20. A probe as defined in claim 1, including a metal field plate positioned on a back side of the web, said back side of the web being opposite to the side of the web facing said probe, said metal field plate being connectable to a source of electric alternating voltage.

21. A probe as defined in claim 20, wherein said field plate is parallel to said web.

22. A probe as defined in claim 20, wherein said source of alternating voltage can be set betweenn 0 and 10 kV with an accompanying frequency between 0 and 10 kHz.

23. A probe as defined in claim 1, including suction slot means extending across said web and positioned upstream of the probe along direction of web movement.

24. A probe as defined in claim 1, including suction slot means extending across said web and being positioned downstream of said probe along direction of web movement.

25. A probe as defined in claim 1, including suction slot means extending across web at an angle of substantially 40° to 60° to said web.

26. A probe as defined in claim 1, wherein said subsidiary electrodes are blade-shaped electrodes.

27. A probe as defined in claim 1, wherein said nozzles are round-shaped nozzles.

28. A probe as defined in claim 1, wherein said nozzles comprise slotted nozzles.

29. A probe for removing dust from moving paper webs, comprising at least one electrostatic high-voltage electrode; at least one air blower oriented against the direction of web movement; a vacuum channel for suctioning up dust-laden air; said high-voltage electrode comprising subsidiary electrodes lying in a first plane substantiallyy perpendicular to said web; said blower having a row of nozzles blowing along a direction lying in a second plane inclined with respect to said first plane; said blower being located downstream of said high-voltage electrode in direction of web movement; said two planes intersecting at a line lying in a plane of the web and extending across said web; and openings into said vacuum channel being positioned upstream of said high-voltage electrode direction of web movement; said air blower blowing air in a direction opposite to direction of web movement for breaking up an air stream of substantially laminar flow moving with said web to produce turbulence that picks up dust through the turbulence; said nozzles on said blower having a direction to apply an air stream onto said openings in said vacuum channel for producing maximum suction of air particles carried by the turbulence; said electrostatic high-voltage electrode being located in vicinity of the dust picked up by the turbulence; said subsidiary electrodes comprising pointed electrodes.

30. A probe for removing dust from moving paper webs, comprising at least one electrostatic high-voltage electrode; at least one air blower oriented against the direction of web movement; a vacuum channel for suctioning up dust-laden air; said high-voltage electrode comprising subsidiary electrodes lying in a first plane substantially perpendicular to said web; said blower having a row of nozzles blowing along a direction lying in a second plane inclined with respect to said first plane; said blower being located downstream of said high-voltage electrode in direction of web movement; said two planes intersecting at a lying in a plane of the web and extending across said web; and openings onto said vacuum channel being positioned upstream of said high-voltage electrode web-travel direction; said air blower air in a direction opposite to direction of web movement for breaking up an air stream of substantially laminar flow moving with said web to produce turbulence that picks up dust through the turbulence; said nozzles on said blower having a direction to apply an air stream onto said openings in said vacuum channel for producing maximum suction of air particles carried by the turbulence; said electrostatic high-voltage electrode being located in vicinity of the dust picked up by the turbulence; said electrodes being pointed electrodes parallel to one another in said first plane; said blower having an additional row of nozzles lying in a third plane intersecting also said line of intersection; said nozzles comprising round-shaped bores parallel to one another in said second or third plane; said line of intersection being perpendicular to web-travel direction; said openings in said vacuum channel being located in vicinity of said web; flow into all openings in said vacuum channel having a direction lying within a fourth plane oriented at an acute angle to web-travel direction; said probe having a trapezoidal-shaped chamber with larger base and smaller base, said larger base facing said web, said high-voltage electrode having an end located at said smaller base, said blower being positioned on one side of said chamber and inflow opening into said vacuum channel being positioned on another side of said chamber; a first ground electrode positioned upstream of said vacuum channel; a second ground electrode located downstream of said blower along direction of web movement; said ground electrodes being positioned on a bottom facing web and extending over a total width of said probe; said ground electrodes being located outside said trapezoidal-shaped recess chamber; a metal field plate positioned on a back side of said web and connectable to a source of electric alternating voltage, said field plate being parallel to said web; and suction slot means extending across said web.

* * * * *